US007036903B2

(12) United States Patent
Choi

(10) Patent No.: US 7,036,903 B2
(45) Date of Patent: May 2, 2006

(54) INKJET PRINTER CHECKING NOZZLE AND PROVIDING ABNORMAL NOZZLE INFORMATION AND METHOD THEREOF

(75) Inventor: Kyung-chool Choi, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/299,818

(22) Filed: Nov. 20, 2002

(65) Prior Publication Data

US 2003/0156149 A1 Aug. 21, 2003

(30) Foreign Application Priority Data

Feb. 15, 2002 (KR) ..... 2002-8093

(51) Int. Cl.
*B41J 29/393* (2006.01)

(52) U.S. Cl. ..... 347/19

(58) Field of Classification Search ..... 347/19, 347/23, 7

See application file for complete search history.

(56) References Cited

U.S. PATENT DOCUMENTS 4,996,487 A * 2/1991 McSparran et al. ..... 347/19
5,072,235 A * 12/1991 Slowik et al. ..... 347/19
5,319,389 A * 6/1994 Ikeda et al. ..... 347/19
5,786,828 A * 7/1998 Yamamoto ..... 347/19
6,076,914 A * 6/2000 Imai ..... 347/19
6,120,125 A * 9/2000 Kim ..... 347/19
6,130,683 A * 10/2000 Ju ..... 347/19
6,199,969 B1 * 3/2001 Haflinger et al. ..... 347/19
6,371,590 B1 * 4/2002 Hah ..... 347/19
6,375,299 B1 * 4/2002 Foster et al. ..... 347/19

* cited by examiner

*Primary Examiner*—K. Feggins
*Assistant Examiner*—Julian D. Huffman
(74) *Attorney, Agent, or Firm*—Staas & Halsey LLP

(57) ABSTRACT

An inkjet printer checks whether each nozzle on a printing head is normal, and upon receipt of a nozzle checking command for a nozzle of a printing head through an inputting unit, cuts off a first driving power supply provided during a normal operation and drives in sequence a plurality of nozzle driving units using a second driving power supply. Through such operation, the inkjet printer determines a state of each nozzle driving unit in accordance with an output signal from a comparator comparing a voltage level during driving of each nozzle driving unit with a reference voltage, and then stores a nozzle number corresponding to the nozzle driving unit whose failure is detected. Upon completion of checking for each nozzle driving unit, the stored nozzle number representing an abnormal nozzle is displayed on a display. Therefore, it is possible for a user to check an abnormal state of the nozzle driving unit and to recognize exactly reasons for an improper dot formation on a printing medium, whereby ink consumption due to unnecessary spitting is prevented.

25 Claims, 4 Drawing Sheets

INKJET PRINTER CHECKING NOZZLE AND PROVIDING ABNORMAL NOZZLE INFORMATION AND METHOD THEREOF

CROSS-REFERENCE TO RELATED APPLICATIONS

This application claims the benefit of Korean Patent Application No. 2002-8093, filed Feb. 15, 2002, in the Korean Intellectual Property Office, the disclosure of which is incorporated herein by reference.

BACKGROUND OF THE INVENTION

1. Field of the Invention

The present invention relates to an inkjet printer, and particularly, to an inkjet printer capable of checking whether a head nozzle is normal, and a method thereof.

2. Description of the Related Art

A printer is now considered as an indispensable peripheral device for a PC user. The popularity of the printer is primarily due to an emergence of an inkjet color printer of a low price.

Generally, an inkjet printer is configured such that ink is ejected on a paper through a fine nozzle provided to a printing head. Here, among various methods of ejecting ink through the nozzle, a method of heating the nozzle of the printing head is most widely used. In this method, the printing head includes a heat resistance $R_H$ heating the nozzle, and a driving unit M1 supplying a driving power $V_f$ to the heat resistance $R_H$ in responsive to an address input signal. Hereinafter, the heat resistance $R_H$ and the driving unit M1 are commonly called a nozzle driving unit. Although one single driving unit M1 and one single heat resistance $R_H$ are shown in the drawings, a plurality of nozzles are provided in the printing head, and the nozzle driving unit shown in FIG. 1 is arranged on every nozzle.

In the meantime, dpi (dot per inch) represents a resolution of a printed image and is used as one of standards for measuring a printer performance. More specifically, dpi is a numerical value meaning how many dots are arranged within one inch. For example, 600 dpi means there are six hundred dots within one inch. A comparison between printing results for 360 dpi and 720 dpi shows that the printing results (printed images) are quite different in their dot densities.

In the inkjet printer mentioned above, there occurs a case in which a dot is not formed properly on a printing medium due to a driving unit failure or an ink stoppage of the nozzle. In a case that the dot is not properly formed or considered not properly formed, a user comes to check the result again and again by a spitting method. Malfunction due to the nozzle stoppage like the above case, could be repaired through the spitting method, but in a case of a problem in a nozzle driving circuit, unnecessary consumption of ink is caused. That is, the user is not able to know exactly whether the improper formation of the dot is due to the nozzle stoppage or due to a nozzle driving circuit failure.

SUMMARY OF THE INVENTION

An object of the invention is to solve the above and other problems and/or disadvantages by providing an inkjet printer capable of checking a driving circuit of a nozzle on a printing head from an outside of the printing head and a method of providing information thereof.

Additional objects and advantageous of the invention will be set forth in part in the description which follows and, in part, will be obvious from the description, or may be learned by practice of the invention.

The foregoing and other objects and advantages of the present invention are achieved by providing an inkjet printer including a printing head having a plurality of nozzle driving units corresponding to a plurality of nozzles so that ink is ejected through the nozzles, a plurality of nozzle failure detecting units outputting a failure checking signal regarding each of the nozzle driving units according to a drop in the voltage level of a driving power supply due to respective driving of a plurality of the nozzle driving units, a display displaying failure checking results regarding the nozzle driving units, and a control unit controlling the display to display an identifier indicating the nozzle driving unit whose failure is detected through the nozzle failure detecting unit.

The nozzle failure detecting unit includes a comparator comparing the voltage level of the driving power supply, which has dropped due to respective driving of the nozzle driving units, with a reference voltage and outputting a high/low signal in accordance with the comparison. Further, the identifier can be displayed as a nozzle number previously given (assigned) to each of the nozzles.

Also, the inkjet printer further includes a host interface interfacing data with a host, wherein the control unit transmits identifier information to the host so that the host may display the nozzle driving unit whose failure is detected.

To achieve the above and other objects, a method of providing abnormal nozzle information in the inkjet printer according to the present invention includes driving the nozzle driving units provided for ink to be ejected through the nozzles of the printing head, comparing the voltage level of the driving power supply during driving respective nozzle driving units with the reference voltage, determining a failure regarding each of the nozzle driving units according to comparison results, and displaying an identifier indicating the nozzle driving unit whose failure is determined in accordance with the determination of the failure.

Here, the method further includes storing the identifier for each nozzle driving unit whose failure is determined after performing the determining of the failure, and wherein the displaying of the identifier displays identifiers collectively stored in the identifier storing operation. Further, the identifier may be a nozzle number previously given to the nozzle corresponding to each of the nozzle driving units.

To achieve the above and other objects, an inkjet printer according to another embodiment of the present invention includes a printing head having a plurality of nozzle driving units corresponding to a plurality of nozzles to eject ink by supplying a first driving power supply to each of the nozzle driving units through a first voltage switching unit, a plurality of nozzle failure detecting units supplying a second driving power supply to each nozzle driving unit and outputting a failure checking signal regarding each of the nozzle driving units according to a voltage level of a driving power supply, which has dropped due to respective driving of the nozzle driving units, an inputting unit receiving a failure checking command regarding each of the nozzle driving units, a display displaying failure checking results regarding the nozzle driving units, and a control unit cutting off the first driving power supply provided during a normal operation of the nozzle driving units upon receipt of the failure checking command, driving in sequence the nozzle driving units by the second power supply, and displaying on the display an identifier indicating the nozzle driving unit whose failure is detected among the nozzle driving units.

The nozzle failure detecting unit includes a voltage switching unit switching the second driving power supply to a power supply input terminal of the nozzle driving unit in response to a nozzle check controlling signal, and a comparator comparing the voltage level of the second driving power supply provided to the power supply input terminal of the nozzle driving unit with a reference voltage and outputting a high/low signal in response to the comparison. Here, the second voltage switching unit is connected between an input terminal of the second driving power supply and the power supply input terminal of the nozzle driving unit and includes a transistor turned on in response to a nozzle check controlling signal.

Also, the inkjet printer further includes a host interface interfacing data with a host, wherein the control unit transmits identifier information to the host so that the host may display the nozzle driving unit whose failure is detected.

To achieve the above and other objects, a method of providing abnormal nozzle information to the inkjet printer according to another aspect of the present invention includes upon receipt of a nozzle checking command for checking whether the nozzle of the printing head is normal, driving in sequence the nozzle driving units provided for ink to be ejected through the nozzles of the printing head, comparing the voltage level of the driving power supply, which has dropped due to respective sequential driving of the nozzle driving units, with a reference voltage, determining a failure regarding the driven nozzle driving units according to comparison results of the comparator, and displaying an identifier corresponding to the nozzle driving unit whose failure is determined in accordance with the determination of the failure.

Here, the method further includes storing the identifier indicating each nozzle driving unit whose failure is determined after performing the determining operation, wherein the displaying of the identifier includes displaying identifiers collectively stored in the identifier storing operation. The method further includes, upon receipt of the nozzle checking command, cutting off the first driving power supply provided during the normal operation of the nozzle driving unit and supplying the second driving power supply to the nozzle driving units.

The inkjet printer of the present invention as mentioned above makes it possible for a user to examine reasons for an improper formation of a dot formed on a printing medium, thereby preventing an unnecessary consumption of ink.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The above and other objects, features and advantages of the present invention will become more apparent and more readily appreciated from the following description of the preferred embodiments, taken in conjunction with the accompanying drawings in which.

DETAILED DESCRIPTION OF THE PREFERRED EMBODIMENTS

Figure 1:
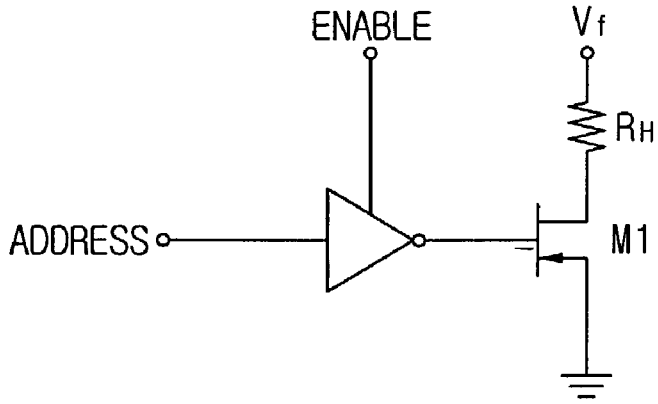
FIG. 1 (PRIOR ART)
FIG. 1 is circuit diagram illustrating a nozzle driving unit of a conventional inkjet printer.

Reference will now be made in detail to the present preferred embodiments of the present invention, examples of which are illustrated in the accompanying drawings, wherein like reference numerals refer to the like elements throughout. The embodiments are described in order to explain the present invention by referring to the Figures.

The matters defined in the description such as a detailed construction and elements of the present invention are nothing but the ones provided to assist in a comprehensive understanding of the invention. Thus, it is apparent that the present invention can be carried out, not limited to those defined matters. Also, well-known functions or constructions are not described in detail since they would obscure the invention in unnecessary detail.

Figure 2:
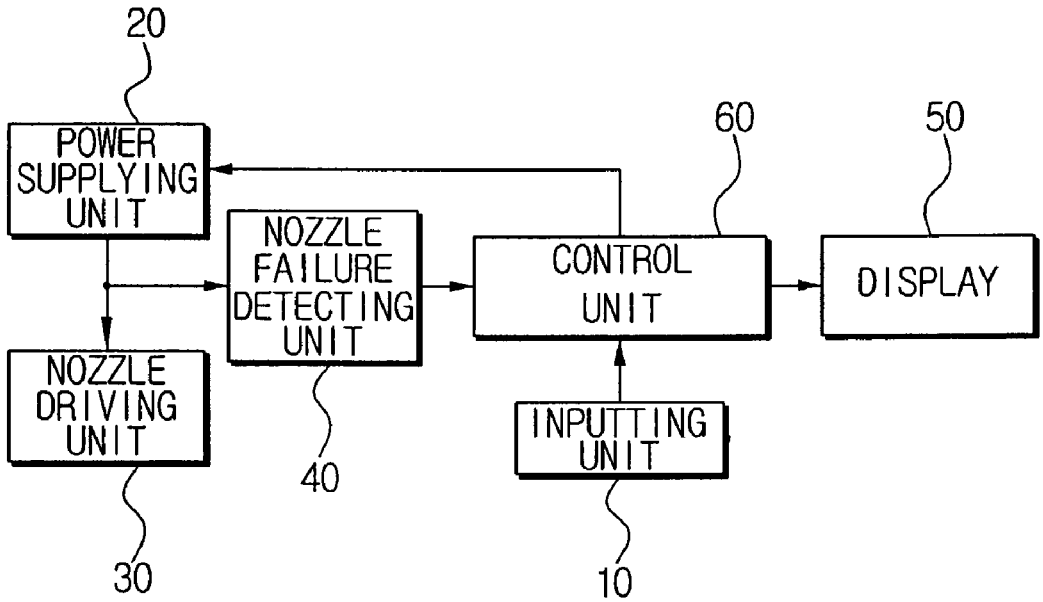
FIG. 2 is a schematic block diagram of an inkjet printer according to an embodiment of the present invention.

FIG. 2 is a schematic block diagram of an inkjet printer according to an embodiment of the present invention. The inkjet printer includes an inputting unit 10, a power supplying unit 20, a nozzle driving unit 30, a nozzle failure detecting unit 40, a display 50, and a control unit 60.

The inputting unit 10 has a plurality of command keys (not shown) for receiving an operation command of an inkjet printer from a user, and a command key (not shown) for receiving a nozzle checking command from the user for checking whether a nozzle is normal, is included in the command keys.

Figure 3:
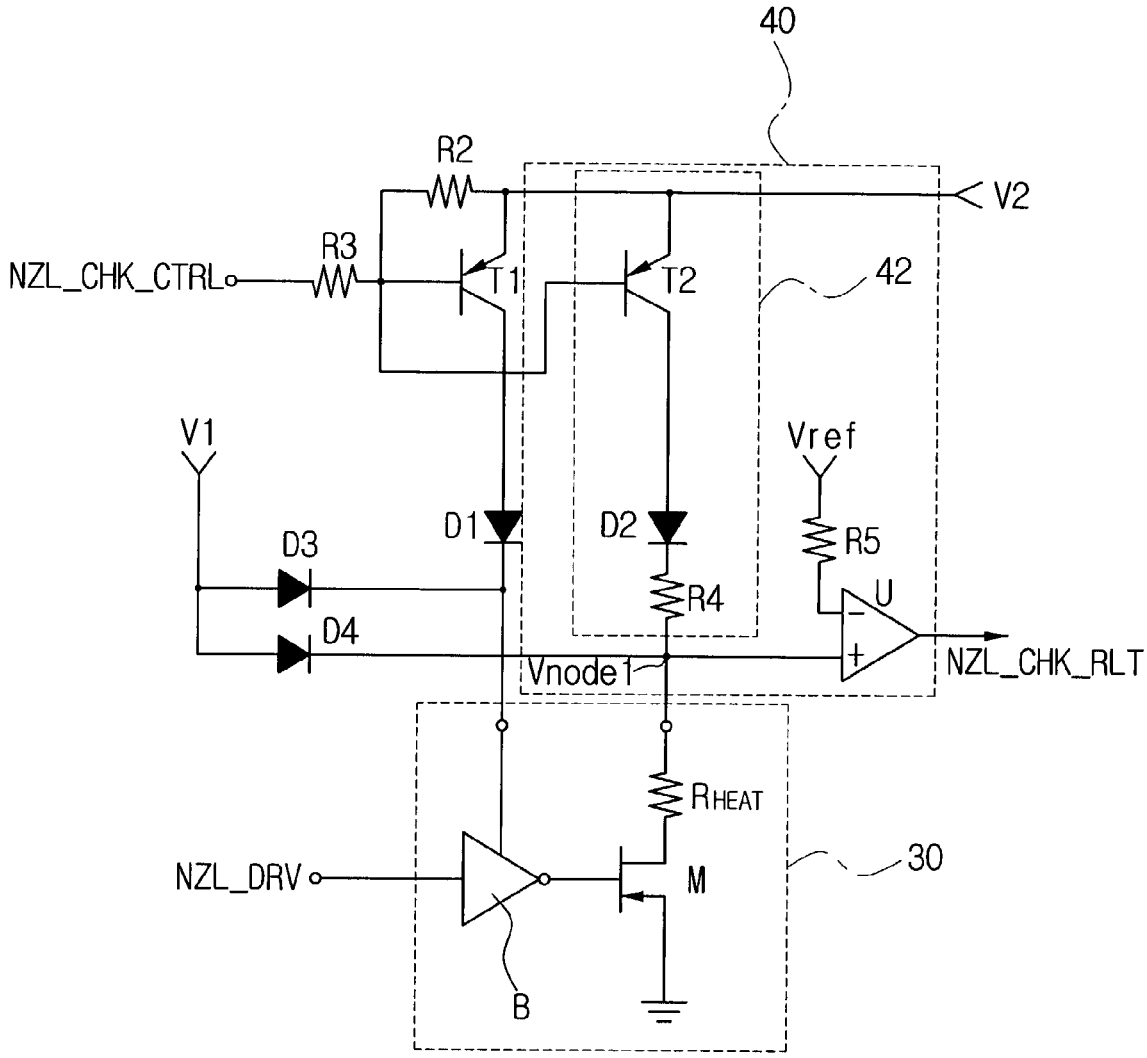
FIG. 3 is a detailed circuit diagram for a nozzle driving unit and a nozzle failure detecting unit of the inkjet printer shown in FIG. 2.

The power supplying unit 20 supplies a driving power supply to the nozzle driving unit 30 provided to a printing head to drive the nozzle driving unit 30. The nozzle driving unit 30 is supplied with the driving power supply from the power supplying unit 20 and heats the nozzle. For this operation, the nozzle driving unit 30 includes a heat resistance $R_{HEAT}$ and a driving unit M supplying the driving power supply to the heat resistance $R_{HEAT}$ using a nozzle driving signal NZL_DRV as shown in FIG. 3. The heat resistance $R_{HEAT}$ represents a heater or various types of drivers included in the nozzle driving unit 30 to cause ink to be ejected through the nozzle. The driving unit M, e.g., an FET (Field Effect Transistor), receives the nozzle driving signal NZL_DRV through a gate terminal. Further, the nozzle driving unit 30 has an inverter B controlling the nozzle driving signal NZL_DRV to be input to the gate terminal of the driving unit M. In FIG. 3, the inverter B of the nozzle driving unit 30 receives a normal (first) driving power supply V1 as a first enabling signal during a normal operation while receiving a second driving power supply V2 for nozzle checking use as a second enabling signal during a nozzle checking operation. Here, although the nozzle driving unit is represented as one single block, a plurality of nozzle driving units are provided to the printing head to correspond to respective nozzles. The nozzle driving unit shown in FIG. 3 is a representative one as an example.

The nozzle failure detecting unit 40 outputs a failure checking signal in response to a drop in the voltage level of the driving power supply occurring due to the driving of the nozzle driving unit 30. At this moment, the driving power supply could be the normal driving power supply V1 provided during the normal operation of the nozzle driving unit 30, or could be the second driving power supply V2 provided only upon receipt of a nozzle checking command through the inputting unit 10. In a case of checking whether the nozzle driving unit 30 is normal in accordance with the voltage level of the normal driving power supply V1 provided through diodes D3, D4 during the normal operation, a comparator U compares a reference voltage Vref, which is coupled to the comparator U through a resistor R5, with the voltage level (Vnode1) of the driving power supply and outputs a high/low signal to the nozzle failure detecting unit 40.

In the meantime, in the case of checking whether the nozzle driving unit 30 is normal using the second driving power supply V2, a circuit as shown in FIG. 3 could be used for the nozzle failure detecting unit 40. FIG. 3 is a detailed circuit diagram of the nozzle failure detecting unit 40, which includes a switching unit 42 switching the driving power supply from the normal power supply V1 to the second driving power supply V2 in response to a nozzle checking controlling signal NZL_CHK_CTRL transmitted from the control unit 60 through resistors R2, R3, and the comparator U comparing the voltage drop level (Vnode1) of the second driving power supply V2 supplied to the heat resistance $R_{HEAT}$ of the nozzle driving unit 30 by operation of the switching unit 42, with the reference voltage Vref. The nozzle failure detecting unit 40 transmits the second driving power supply V2 to the inverter B through a first transistor T1 and a first diode D1 in response to the nozzle checking controlling signal NZL_CHK_CTRL.

The switching unit 42 has a transistor T2 to respond to the nozzle checking controlling signal NZL_CHK_CTRL, a second diode D2, and a resistor R4 connected in a series to the transistor T2.

The display 50 displays an identifier corresponding to the nozzle driving unit 30. An identifier could be a nozzle number previously given (assigned) to each nozzle corresponding to each of the nozzle driving unit 30.

The control unit 60 controls various functions of the inkjet printer and particularly controls the display 50 to display an identifier corresponding to the nozzle driving unit 30 whose failure is detected through the nozzle failure detecting unit 40. Here, the control unit 60, in a case that the nozzle checking command is received through the inputting unit 10, cuts off the normal driving power supply V1 provided during the normal operation, outputs the nozzle checking controlling signal NZL_CHK_CTRL so as to provide the second driving power supply V2 to the nozzle driving unit 30, and compares the voltage level (Vnode1) of the second driving power supply V2 by driving of the nozzle driving unit 30, with the reference voltage Vref so as to check whether the nozzle driving unit 30 is normal. In the meantime, the control unit 60 could also compare, without generating the second driving power supply V2, the voltage level (Vnode1) generated during driving of the nozzle driving unit 30 in the normal operation of the nozzle driving unit 30, with the reference voltage Vref to check whether the nozzle driving unit 30 is normal.

Also, although not shown in FIG. 2, the inkjet printer further includes a host interface interfacing data with a host, wherein the control unit 60 could transmit identifier information to the host so that the host may display the identifier information representing the nozzle driving unit 30 whose failure is detected.

Figure 4:
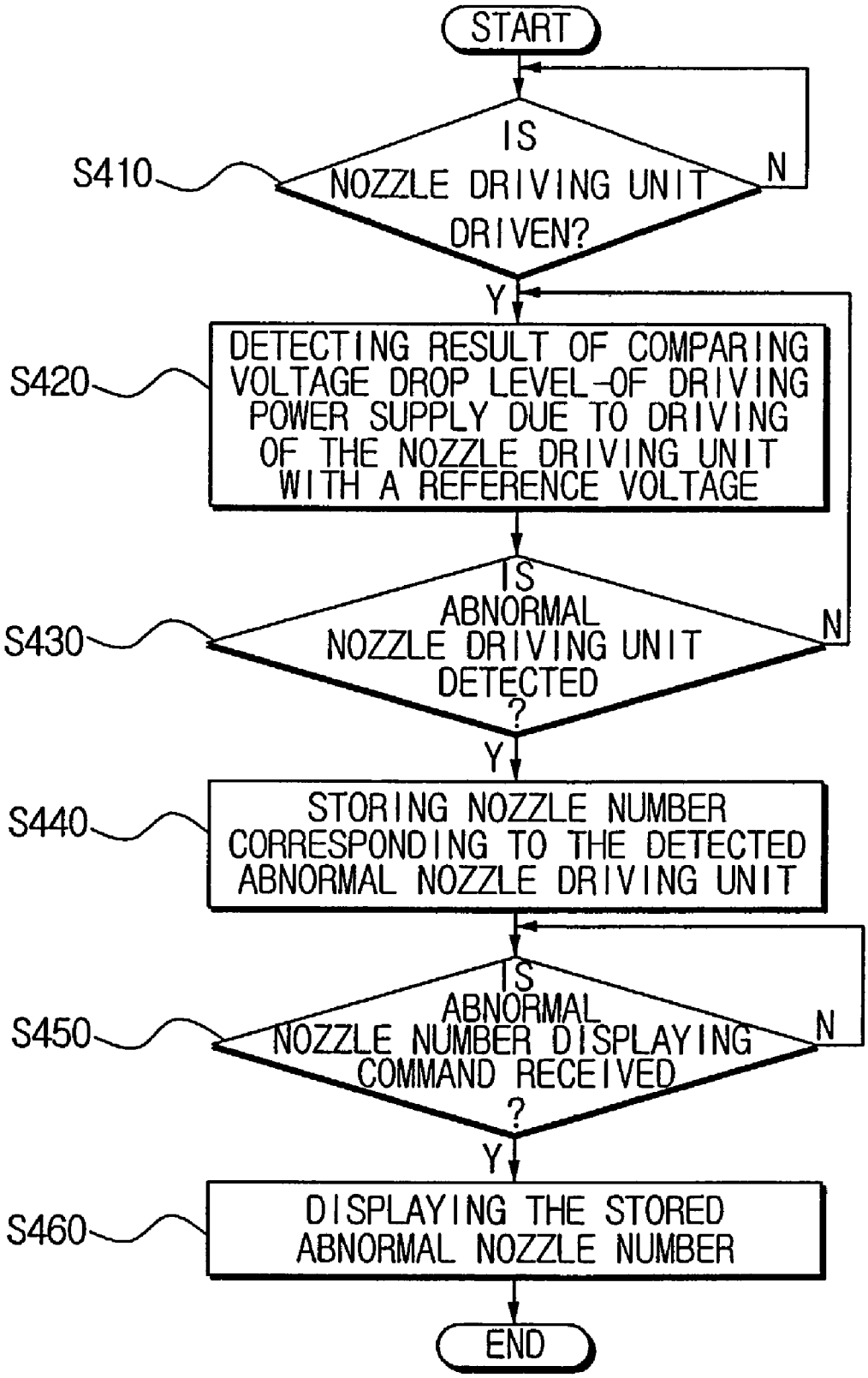
FIG. 4 is a flowchart illustrating an operation of the inkjet printer shown in FIG. 2.

FIG. 4 is a flowchart illustrating an operation of the inkjet printer shown in FIG. 2. When the nozzle driving unit 30 is driven during the normal operation of the inkjet printer in operation S410, the control unit 60 detects results of comparing the voltage level (Vnode1) of the normal driving power supply V1 due to the driving of the nozzle driving unit 30 with the reference voltage Vref through the comparator U in operation S420. Then, when it is determined whether the nozzle driving unit 30 is normal or not through the high/low signal representing a comparison result of the comparator U in operation S430, a nozzle number corresponding to the nozzle driving unit 30 whose failure is detected, is stored in operation S440. After that, when a displaying command regarding the nozzle detected as failed, is received through the inputting unit 10 in operation S450, the stored nozzle number is displayed on the display 50 in operation S460.

Through the foregoing operation, the nozzle driving unit 30 having a nozzle failure is detected and stored during the normal operation of the inkjet printer, and in a case that a user wants to know reasons for the nozzle failure, information about a failed nozzle could be immediately provided. At the moment, the switching unit 42 in FIG. 3 supplying the second driving power supply V2 is not necessarily required.

Figure 5:
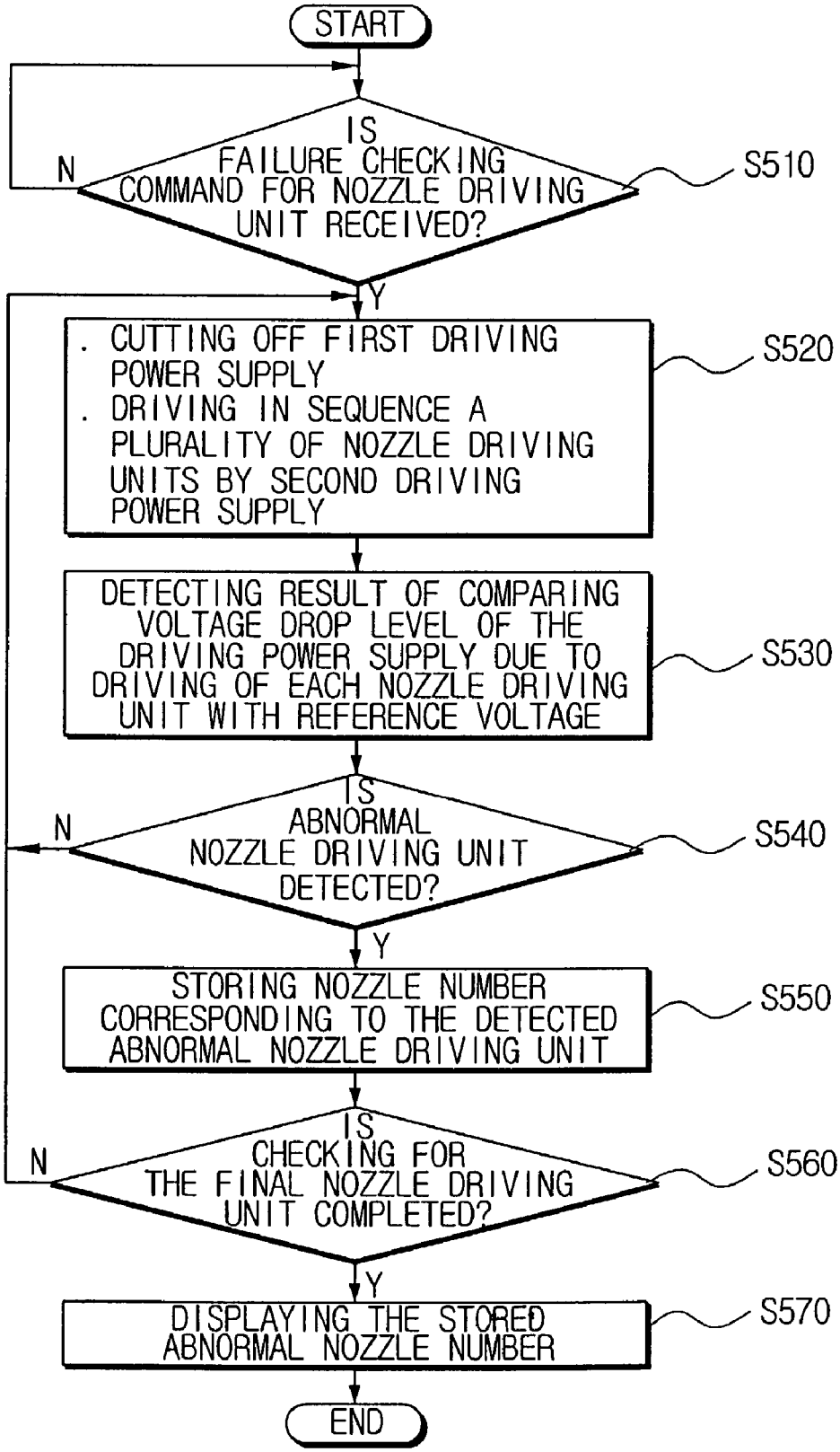
FIG. 5 is a flowchart illustrating another operation of the inkjet printer shown in FIG. 2.

FIG. 5 is a flowchart illustrating another operation of the inkjet printer shown in FIG. 2. First of all, when a failure checking command for the nozzle driving unit 30 is received through the inputting unit 10 in operation S510, the control unit 60 cuts off the normal driving power supply V1 provided during the normal operation, driving in sequence the nozzle driving units 30 by the second driving power supply V2 in operation S520. That is, in FIG. 3, the control unit 60 cuts off the normal driving power supply V1, outputting the nozzle checking controlling signal NZL_CHK_CTRL so as to turn on the first transistor T1 and the second transistor T2. Accordingly, the second driving power supply V2 is provided to the inverter B through the first transistor T1 and the first diode D1 and provided to the heat resistance $R_{HEAT}$ of the nozzle driving unit 30, respectively, through the second transistor T2, the second diode D2 and the fourth resistance R4. Through such an operation, the voltage level is generated in electric potential on the first node (Vnode1), and the comparator U compares the voltage on the first node (Vnode1) with the reference voltage Vref and outputs the high/low signal to the control unit 60.

Then, the control unit 60 determines a state of the nozzle driving unit 30 to be normal when an output signal from the comparator U is high while determining an abnormal state of the nozzle driving unit 30 when the output signal from the comparator U is low in operation S530. When the control unit 60 detects the low output signal from the comparator U through the foregoing process in operation S540, the nozzle number corresponding to the nozzle driving unit 30 currently driven is stored in operation S550. And, when failure checking of each nozzle driving unit 30 is completed by sequential driving of each nozzle driving unit 30 using the second driving power supply V2 as mentioned above in operation S560, the control unit 60 displays on a display 50 an abnormal (failed) nozzle number stored without an additional command in operation S570.

As shown in FIG. 5, the abnormal nozzle number does not need to be displayed on the display 50 only after the checking is completed with respect to all of the nozzle driving units 30. In other words, without performing the storing operation, when the abnormal nozzle number is detected, a corresponding nozzle number could be immediately displayed on the display 50 before the checking is completed. Further, it is not always necessary to operate the nozzle driving unit 30 using the second driving power supply V2 so as to comparing the voltage level with the reference voltage Vref. Instead, by providing the normal driving power supply V1 during the normal operation to the nozzle driving unit 30 and inputting in sequence the nozzle driving signal NZL_DRV to each nozzle driving unit 30, the voltage level (Vnode1) could be obtained.

As is apparent from the foregoing, the inkjet printer of the present invention is capable of checking whether the nozzle driving unit is normal by applying a predetermined voltage and current to the nozzle driving unit, whereby the user could recognize exactly reasons for the improper dot formation on a printing medium, so that consumption of ink due to unnecessary spitting is prevented.

Though the invention has been shown and described with reference to a certain preferred embodiment thereof, it will be understood by those skilled in the art that various changes in form and details may be made therein without departing from the spirit and scope of the invention as defined by the appended claims and their equivalents.

What is claimed is:

1. An inkjet printer comprising:

a printing head having a plurality of nozzles and a plurality of nozzle driving units corresponding to the nozzles through which ink is ejected, and receiving a driving power supply from an external power source;

a nozzle failure detecting unit detecting a voltage level of the driving power supply during printing where respective nozzle driving units are driven, and outputting a failure checking signal regarding one of the nozzle driving units according to a result of comparing the voltage level of the driving power supply with a reference voltage;

a display displaying a failure checking signal regarding the one of the nozzle driving units; and a control unit displaying on the display an identifier representing a corresponding one of the nozzle driving units whose failure is detected through the nozzle failure detecting unit, in response to the failure checking signal, the identifier being displayed before failure checking signals regarding all of the nozzle driving units are outputted.

2. The inkjet printer according to claim 1, wherein the identifier is a nozzle number given to each of the nozzles.

3. The inkjet printer according to claim 1, further comprising a host interface interfacing data with a host, and the control unit transmits identifier information to the host so that the host may display the identifier information representing the nozzle driving unit whose failure is detected.

4. An inkjet printer comprising:

a printing head having a plurality of nozzles and a plurality of nozzle driving units corresponding to the nozzles through which ink is ejected, and receiving a driving power supply from an external power source;

a nozzle failure detecting unit detecting a voltage level of the driving power supply during printing where respective nozzle driving units are driven, and outputting a failure checking signal regarding one of the nozzle driving units in response to the voltage level of the driving power supply;

a display displaying a failure checking signal regarding the one of the nozzle driving units; and a control unit displaying on the display an identifier representing a corresponding one of the nozzle driving units whose failure is detected through the nozzle failure detecting unit, in response to the failure checking signal, wherein the nozzle failure detecting unit comprises:

a comparator comparing the voltage level of the driving power supply with a reference voltage and outputting a high/low signal corresponding to the failure checking signal.

5. A method of providing abnormal nozzle information in an inkjet printer, comprising:

driving a plurality of nozzle driving units provided for allowing ink to be ejected through a plurality of nozzles of a printing head;

detecting comparison results of comparing a voltage level of a driving power supply, occurring during printing that results in the driving of respective nozzle driving units, with a reference voltage;

determining a failure regarding each of the nozzle driving units according to the comparison results; and displaying an identifier representing a corresponding one of the nozzle driving units whose failure is determined as a result of the determination of the failure.

6. The method according to claim 5, further comprising storing the identifier representing the nozzle driving unit whose failure is determined after carrying out the determining of the failure, and the displaying of the identifier comprises:

displaying the stored identifier on the display.

7. The method according to claim 5, wherein the identifier is a nozzle number given to one of the nozzles corresponding to one of the nozzle driving units.

8. An inkjet printer comprising:

a printing head having a plurality of nozzles and a plurality of nozzle driving units corresponding to the nozzles through which ink is ejected, and receiving a first driving supply from an external power source during a normal operation;

a nozzle failure detecting unit supplying a second driving power supply to the nozzle driving units during a checking operation, detecting a voltage level of the second driving power supply during driving of the nozzle driving units, and outputting a failure checking signal regarding each of the nozzle driving units in response to the voltage level of the driving power supply;

an inputting unit receiving a failure checking command regarding each of the nozzle driving units to perform the checking operation;

a display displaying a failure checking result regarding the nozzle driving units; and a control unit cutting off the first driving power supply, upon receipt of the failure checking command, driving in sequence the nozzle driving units with the second power supply, and displaying on the display an identifier representing a corresponding one of the nozzle driving units whose failure is detected.

9. The inkjet printer according to claim 8, wherein each nozzle driving unit comprises a power supply input terminal, and the nozzle failure detecting unit comprises:

a voltage switching unit transmitting the second driving power supply to the power supply input terminal of the nozzle driving unit in response to a nozzle check controlling signal; and a comparator comparing the voltage level of the second driving power supply with a reference voltage, and outputting a high/low signal corresponding to the identifier.

10. The inkjet printer according to claim 9, wherein the voltage switching unit is connected between the external power source and the input terminal of the nozzle driving unit, and comprises:

a transistor turned on in responsive to the nozzle check controlling signal to transmit the second driving power supply to the nozzle driving unit.

11. The inkjet printer according to claim 8, further comprising a host and a host interface interfacing data with the host, and the control unit transmits identifier information to the host so that the host may display the identifier information relating to the nozzle driving unit whose failure is detected.

12. A method of providing abnormal nozzle information in an inkjet printer, comprising:

driving in sequence a plurality of nozzle driving units provided for causing ink to be ejected through a plurality of nozzles of a printing head, and upon receipt of a nozzle checking command cutting off a first driving power supply provided during normal operation and supplying a second driving power supply to the nozzle driving units;

detecting comparison results of comparing a voltage level of the second driving power supply due to sequential driving of respective nozzle driving units with a reference voltage;

determining a failure regarding one of the driven nozzle driving units according to the comparison results during the ejecting of the ink; and displaying an identifier corresponding to the nozzle driving unit whose failure is determined as a result of the determination of the failure.

13. The method according to claim 12, further comprising storing the identifier after carrying out the determining of the failure, and the displaying of the identifier comprises:

displaying the stored identifier.

14. A printing apparatus, comprising:

a power supply unit generating a driving power supply;

a nozzle;

a nozzle driving unit driving the nozzle in response to the driving power supply;

a display; and a nozzle failure detecting unit detecting a voltage level of the driving power supply during printing that results in driving the nozzle driving unit, and immediately displaying a failure signal on the display, the failure signal indicating that the nozzle driving unit is not normal in response to the detected voltage level.

15. The apparatus according to claim 14, further comprising:

a control unit generating a nozzle driving signal and a nozzle checking controlling signal, wherein the nozzle driving unit drives the nozzle with the driving power supply in response to the nozzle driving signal.

16. The apparatus according to claim 14, further comprising:

an input unit generating a nozzle checking command, wherein the nozzle failure detecting unit detects the voltage level of the nozzle driving power in response to the nozzle checking command.

17. A printing apparatus, comprising:

a power supply unit generating a driving power supply;

a nozzle;

a nozzle driving unit driving the nozzle in response to the driving power supply;

a nozzle failure detecting unit detecting a voltage level of the driving power supply during printing that results in driving the nozzle driving unit, and immediately outputting a failure signal indicating that the nozzle driving unit is not normal in response to the detected voltage level; and a control unit generating a nozzle driving signal and a nozzle checking controlling signal, wherein the nozzle driving unit drives the nozzle with the driving power supply in response to the nozzle driving signal, wherein the power supply unit generates a second driving power supply, the first driving power supply used during the normal operation is cut off from the nozzle driving units, and the nozzle driving unit drives the nozzle with the second driving power supply in response to the nozzle checking controlling signal.

18. The apparatus according to claim 17, wherein the nozzle failure detecting unit detects a second voltage level of the second driving power supply to output the failure signal.

19. The apparatus according to claim 17, wherein the nozzle driving unit comprises:

a resistor representing a heater;

a transistor driving the resistor; and an inverter transmitting the driving power supply to the transistor in response to the nozzle driving signal and the second driving power supply to the transistor in response to the nozzle checking controlling signal.

20. The apparatus according to claim 19, wherein the power supply unit supplies one of the first driving power supply and the second driving power supply to the inverter and the resistor.

21. The apparatus according to claim 19, wherein the nozzle failure detecting unit comprises:

a comparator having a first terminal connected between the power supply unit and the resistor;

a second input terminal receiving a reference potential; and an output terminal outputting an output corresponding to the failure signal.

22. The apparatus according to claim 19, wherein the nozzle failure detecting unit comprises:

a second transistor transmitting the second driving power supply to the inverter and the resistor in response to the nozzle checking controlling signal.

23. An inkjet printer comprising:

a printing head having a plurality of nozzles and a plurality of nozzle driving units corresponding to the nozzles through which ink is ejected, and receiving a driving power supply from an external power source;

a nozzle failure detecting unit detecting a voltage level of the driving power supply during printing where respective nozzle driving units are driven, and outputting a failure checking signal regarding one of the nozzle driving units in response to the voltage level of the driving power supply;

a display displaying a failure checking signal regarding the one of the nozzle driving units; and a control unit displaying on the display an identifier representing a corresponding one of the nozzle driving units whose failure is detected through the nozzle failure detecting unit, in response to the failure checking signal, the identified being displayed before failure checking signals regarding all of the nozzle driving units are outputted, wherein an output state of the failure checking signal is determined by:

supplying a reference voltage to a first input terminal of a comparator comprising;

the first input terminal;

a second input terminal; and an output signal;

supplying the driving power supply voltage to the second input terminal;

comparing the voltages at the first input terminal and the second input terminal such that:

when the driving power supply voltage is greater than the reference voltage the output signal has a high state; and when the driving power supply voltage is less than the reference voltage the output signal has a low state.

24. An inkjet printer comprising:

a printing head having a plurality of nozzles and a plurality of nozzle driving units corresponding to the nozzles through which ink is ejected, and receiving a driving power supply;

a nozzle failure detecting unit which constantly detects a voltage level of the driving power supply, compares the voltage level to a reference voltage during printing, and outputs an output signal regarding one of the nozzle driving units in response to the comparison;

a display displaying a failure checking signal regarding the one of the nozzle driving units; and a control unit displaying on the display an identifier representing a corresponding one of the nozzle driving units whose failure is detected through the nozzle failure detecting unit, in response to the failure checking signal.

25. The inkjet printer according to claim 24, wherein the output signal is constantly output as a HI/LO signal in response to the comparison.

* * * * *